US005290459A

United States Patent [19]

Puentes-Bravo et al.

[11] Patent Number: 5,290,459

[45] Date of Patent: * Mar. 1, 1994

[54] BIODEGRADABLE FABRIC SOFTENING COMPOSITIONS BASED ON PENTAERYTHRITOL ESTERS AND FREE OF QUATERNARY AMMONIUM COMPOUNDS

[75] Inventors: Eduardo Puentes-Bravo, Alleur; Anita Hermosilla, Othee; Jean-Paul Grandmaire, Andrimont; Viviane Tack, Ayeneux, all of Belgium

[73] Assignee: Colgate-Palmolive Company, New York, N.Y.

[ * ] Notice: The portion of the term of this patent subsequent to Jun. 30, 2009 has been disclaimed.

[21] Appl. No.: 849,858

[22] Filed: Mar. 12, 1992

Related U.S. Application Data

[63] Continuation of Ser. No. 638,945, Jan. 9, 1991, Pat. No. 5,126,060.

[51] Int. Cl.[5] ..... D06M 13/16; D06M 13/20; D06M 13/26

[52] U.S. Cl. ..... 252/8.6; 252/8.7; 252/8.8; 252/8.9; 252/49.5; 252/51.5 A; 252/51.5 R; 252/174.15

[58] Field of Search ..... 252/8.6, 8.7, 8.8, 8.9, 252/49.5, 51.5 A, 51.5 R, 174.15

[56] References Cited

U.S. PATENT DOCUMENTS

| | | | |
|---|---|---|---|
| 3,959,187 | 5/1976 | Kardol et al. | 252/8.9 |
| 4,062,647 | 12/1977 | Storm et al. | 252/8.8 |
| 4,064,057 | 12/1977 | Koerner et al. | 252/8.6 |
| 4,069,160 | 1/1978 | Hawkins | 252/8.8 |
| 4,105,567 | 8/1978 | Koerner et al. | 252/8.6 |
| 4,126,562 | 11/1978 | Goffinet et al. | 252/8.8 |
| 4,152,272 | 5/1979 | Young | 252/8.8 |
| 4,162,984 | 7/1979 | DeBlock et al. | 252/8.8 |
| 4,217,228 | 8/1980 | Koerner et al. | 252/8.6 |
| 4,312,631 | 1/1982 | Cuntze et al. | 252/8.6 |
| 5,126,060 | 6/1992 | Puentes-Bravo et al. | 252/8.8 |

FOREIGN PATENT DOCUMENTS

| | | |
|---|---|---|
| 48-21353 | 6/1973 | Japan . |
| 0247370 | 2/1990 | Japan . |

*Primary Examiner*—Paul Lieberman
*Assistant Examiner*—Michael P. Tierney
*Attorney, Agent, or Firm*—Bernard Lieberman; Robert C. Sullivan

[57] ABSTRACT

A fabric softening composition or article that is effective for its fabric softening purpose but does not include ecotoxic quaternary ammonium salt, includes, as a fabric softening component, an ester of pentaerythritol, an ester of an oligomer of pentaerythritol, an ester of a lower alkoxylated pentaerythritol or an ester of a lower alkoxylated pentaerythritol oligomer. The fabric softening component is preferably a partial higher fatty acid ester of pentaerythritol or a partial higher fatty acid ester of a pentaerythritol oligomer, the fabric softening composition is an aqueous emulsion or a particulate or powder composition (preferably with the carrier of the powder composition being a fabric softening bentonite) and the fabric softening article is an absorbent material with fabric softening component deposited on it or absorbed by it. Also within the invention are processes for softening fibrous materials, in washed laundry, by employing such compositions and articles, and processes for manufacturing the compositions.

12 Claims, No Drawings

BIODEGRADABLE FABRIC SOFTENING COMPOSITIONS BASED ON PENTAERYTHRITOL ESTERS AND FREE OF QUATERNARY AMMONIUM COMPOUNDS

This is a continuation of application Ser. No. 07/638,945, filed Jan. 9, 1991, now U.S. Pat No. 5,126,060.

This invention relates to fabric softening compositions and/or articles for applications to washed laundry during rinsing and/or drying cycles to apply to the fibers of the fabrics of such laundry fabric softening amounts of fabric softening components of the compositions and/or articles. More particularly, it relates to such compositions and articles that include as fabric softening components higher fatty acid esters of pentaerythritol, of pentaerythritol oligomers, or of ethoxylated derivatives thereof, and which do not contain quaternary ammonium salts.

Fabric softening compositions and articles have long been employed to make washed laundry items softer to the touch and more comfortable to the wearer. Such compositions include solutions, emulsions, and particulate and powder products and such articles include paper strips that have been impregnated with fabric softener. The fabric softeners of choice for most commercial products have usually been quaternary ammonium salts, such as dimethyl ditallowyl ammonium chloride,and emulsions of such softener have been added to the rinse water in the washing machine to effectively soften laundry. Alternatively, such emulsions or powder products including such fabric softener can be added to the wash water, with a detergent composition, or the detergent composition can include a fabric softening component, to make a so-called "softergent". Articles that contain fabric softening component, such as a quaternary ammonium salt, may be added to the automatic laundry dryer, wherein during tumbling of the laundry in a heated environment, the fabric softener is applied to the laundry by repeated contact, and softens it.

Although various fabric softening (and antistatic) compositions have been commercially marketed, with varying degrees of commercial success,over the years and although various fabric softening components thereof have been included in them the most successful of such components have been the quaternary ammonium salts. Such compounds are of the formula

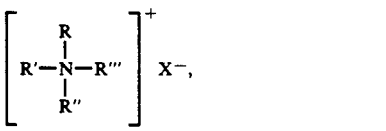

wherein R, R', R'' and R''' are all alkyl groups, with at least one of such alkyls being a higher alkyl and with the others being lower alkyl(s) of 1 or 2 carbon atoms, and with $X^-$ being a salt-forming anion. Preferably, such quaternary ammonium salt is a di-lower alkyl, di-higher alkyl ammonium halide but mono-lower alkyl tri-higher alkyl ammonium halides have also found use in some instances.

While such quaternary ammonium salts have been effective fabric softeners in the described applications they are characterized by disadvantageous properties too, which have led to attempts to find replacements for them. For example, being cationic, they tend to react with anionic materials, sometimes to the detriment of their intended fabric softening function. Moreover, they are not as readily biodegradable as is desirable and they have been found to be toxic to aquatic organisms, which could lead to harmful effects on aquatic life in lakes, rivers and other waters into which waste waters carrying such compounds could be emptied.

In efforts to find replacements for quaternary ammonium salts as fabric softeners, neoalkanamides, glyceryl esters, glycol esters, silicones, cationic-anionic complexes, bentonite and various lubricants have been suggested for use alone or in conjunction with reduced amounts of the quaternary ammonium salts but frequently the softening effects thereof were insufficient or the replacement softeners possessed other characteristics which made them less desirable than the quaternary ammonium salts, despite the disadvantages thereof. Now, however, applicants have discovered that the pentaerythritol esters described herein, and their oligomers and lower alkoxylated derivatives, can satisfactorily soften laundry essentially to the same extent as the quaternary ammonium salts, and do not have the adverse effects on aquatic organisms of such salts. This is an especially important discovery at this time,when the seriousness of the problem is being recognized and when regulations prohibiting the incorporation of quaternary ammonium salts (hereafter "quats") in products that find their ways into sewage and drainage systems a being announced by several countries.

In accordance with the present invention a biodegradable fabric softening composition or article for application to fibrous materials, so that a fabric softening component thereof is deposited on the fibrous materials and softens them, comprises a fabric softening component which is a higher fatty acid ester of pentaerythritol, of an oligomer of pentaerythritol, of a lower alkylene oxide derivative of pentaerythritol or of a lower alkylene oxide derivative of an oligomer of pentaerythritol, or a mixture thereof, in or on a carrier, which composition or article is essentially free of quaternary ammonium halide fabric softener. The invention also includes processes for softening laundry with the described compositions and articles, and manufacturing processes.

A search of prior art relevant to the invention resulted in the finding of the following:

U.S. Pat. Nos.—3,928,212; 4,126,562; 4,142,978; 4,162,984; and 4,214,038;

European Patent Application 276999-A;

German Patent Application 3612479-A; and

Japanese Patent 90 47,370.

U.S. Pat. No. 3,928,212 describes various softening agents which are polyhydric alcohol esters but none of them is a pentaerythritol ester or an ester of an oligomer or ethoxylated derivative of pentaerythritol. U.S. Pat. No. 4,126,562 mentions erythritol and pentaerythritol in a list of alcohols which may be reacted with higher fatty acids to produce fabric conditioning agents but no such compound is actually described and none is shown in a fabric softening composition or article. Also, U.S. Pat. No. 4,126,562 is for a combination of a quaternary ammonium salt fabric softener and a nonionic ester of an alcohol with a higher fatty acid, and there is no teaching that the ester would be useful alone as a fabric softener. U.S. Pat. No. 4,142,978 describes sorbitan esters with phase modifying components, such as alkyl sulfates,on a dryer sheet for softening laundry while it is being tumble dried in an automatic laundry dryer. The patent does not mention any pentaerythritol esters. U.S. Patent No. 4,162,984 relates to a textile treatment emulsion of a water insoluble cationic fabric softener, which is preferably a quaternary ammonium salt or an alkylimidazolinium salt, with a water insoluble nonionic fabric softener, which is preferably a fatty acid ester of a mono- or polyhydric alcohol or an anhydride thereof, and an aromatic mono- or dicarboxylic acid. Among the polyhydric alcohols that may be esterified, according to the patent, is pentaerythritol, but no pentaerythritol ester is described specifically nor is any oligomer of pentaerythritol suggested, and none is shown to be a useful fabric softening agent in the absence of quaternary ammonium salt and aromatic carboxylic acid. It is clear that the patentees did not know of the present invention because they were aware of the disadvantages of the quaternary ammonium salt component (reaction with anionic detergent from the wash cycle) and found that its content could be reduced if the pentaerythritol ester and aromatic carboxylic acid were present, but they never recognized and apparently never made a fabric softening composition which did not contain quaternary ammonium halide or equivalent fabric softener. U.S. Pat. No. 4,214,038 relates to polyglycerol esters as softening agents suitable for deposition on drying laundry from paper substrates charged to the laundry dryer with the laundry being dried. Although polyglycerol is a polyhydric alcohol, as is pentaerythritol, it is not the same as pentaerythritol and the patent does not suggest the use of applicants' pentaerythritol esters as fabric softeners. European patent specification 276999-A mentions fabric conditioning compositions that contain a non-cationic fabric softener and a nonionic cellulose ether. Although esters of polyhydric alcohols are mentioned as suitable conditioning agents, pentaerythritol esters are not disclosed. German patent specification 3612479-A describes textile softening compositions that contain quaternary ammonium compounds with carboxylic esters, and among the carboxylic acid esters are mentioned esters of various alcohols and polyols, including pentaerythritol. However, no such specific ester is described or even named, and no softening composition which does not contain quaternary ammonium compound as the fabric softener is disclosed. Japanese patent 90 47,370 discloses fabric softening compositions that are based on quaternary ammonium salts but may contain higher fatty acid ester of pentaerythritol. No specific such ester is described in the abstract.

In none of the disclosures mentioned above is it taught that any pentaerythritol ester could be employed as a fabric softener in place of quaternary ammonium compound softener and would have essentially as good a softening action, and none of the disclosures mentions any specific pentaerythritol ester nor does any mention any esters of oligomer or lower alkoxylated pentaerythritol or oligomer thereof as a fabric softening agent in a fabric softening composition. Thus, none of the references, either alone or in combination with any of the others, anticipates the present invention or makes it obvious.

The main component of the invented compositions and articles of the present invention, which is essentially the only fabric softening compound in such products, other than bentonite, which may also be present in them, is preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers. Pentaerythritol compound may be abbreviated as PEC herein, which description and abbreviation may apply to any or all of pentaerythritol, oligomers thereof and alkoxylated derivatives thereof, as such or as the ester as will be indicated by the context.

The oligomers of pentaerythritol are preferably those of two to five pentaerythritol moieties, more preferably 2 or 3, with such moieties being joined together through single etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably at least two there of will be esterified by a higher fatty acid or other higher aliphatic acid, which can be of an odd number of carbon atoms.

The higher fatty acid esters of the pentaerythritol compounds are preferably partial esters and more preferably there will be at least two free hydroxyls thereon after esterification (on the pentaerythritol, oligomer or alkoxyalkane) Usually the number of such free hydroxyls is two or about two but sometimes it may be one as in pentaerythritol tristearate, or as many as eight, as in pentapentaerythritol tetrapalmitate.

The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Such may be mixtures of such fatty acids, obtained from natural sources, such as coco fatty acid, commercial stearic acid, tallow acid or hydrogenated tallow acid. Of the pure fatty acids lauric and stearic acids are often preferred, sometimes depending on the penta erythritol moiety esterified. Intermediate synthetic acids of odd numbers of carbon atoms may also be employed.

Examples of some esters within the present invention follow:

-continued

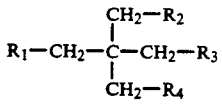

MONOPENTAERYTHRITOL DILAURATE
$R_1 = CH_3-(CH_2)_{10}-COO-$ $R_2 = CH_3-(CH_2)_{10}-COO-$
$R_3 = OH$ $R_4 = OH$

MONOPENTAERYTRITOL MONOSTEARATE
$R_1 = CH_3-(CH_2)_{16}-COO-$ $R_2 = OH$
$R_3 = OH$ $R_4 = OH$

DIPENTAERYTHRITOL ESTERS

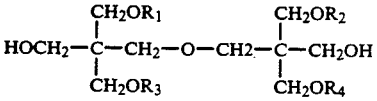

DIPENTAERYTHRITOL TETRALAURATE
$R_1 = CH_3-(CH_2)_{10}-CO$ $R_2 = CH_3-(CH_2)_{10}-CO$
$R_3 = CH_3-(CH_2)_{10}-CO$ $R_4 = CH_3-(CH_2)_{10}-CO$

DIPENTAERYTHRITOL TETRASTEARATE
$R_1 = CH_3-(CH_2)_{16}-CO$ $R_2 = CH_3-(CH_2)_{16}-CO$
$R_3 = CH_3-(CH_2)_{16}-CO$ $R_4 = CH_3-(CH_2)_{16}-CO$

MONOPENTAERYTHRITOL DISTEARATE
$R_1 = CH_3-(CH_2)_{16}-COO-$ $R_2 = CH_3-(CH_2)_{16}-COO-$
$R_3 = OH$ $R_4 = OH$

MONOPENTAERYTHRITOL TRISTEARATE
$R_1 = CH_3-(CH_2)_{16}-COO-$ $R_2 = CH_3-(CH_2)_{16}-COO-$
$R_3 = CH_3-(CH_2)_{16}-COO-$ $R_4 = OH$

MONOPENTAERYTHRITOL MONOBEHENATE
$R_1 = CH_3-(CH_2)_{20}-COO-$ $R_2 = OH$
$R_3 = OH$ $R_4 = OH$

MONOPENTAERYTHRITOL DIBEHENATE
$R_1 = CH_3-(CH_2)_{20}-COO-$ $R_2 = CH_3-(CH_2)_{20}-COO-$
$R_3 = OH$ $R_4 = OH$

PENTAERYTHRITOL 10 ETHYLENE OXIDE ESTER:

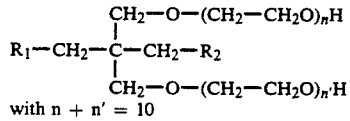

with $n + n' = 10$

MONOPENTAERYTHRITOL 10 ETHYLENE OXIDE DISTEARATE:
$R_1 = CH_3-(CH_2)_{16}-COO-$ $R_2 = CH_3-(CH_2)_{16}-COO-$

PENTAERYTHRITOL 4 PROPYLENE OXIDE ESTERS

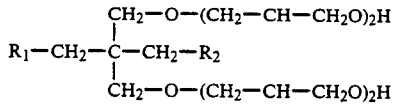

MONOPENTAERYTHRITOL 4 PROPYLENE OXIDE MONOSTEARATE
$R_1 = CH_3-(CH_2)_{16}-COO-$ $R_2 = OH$

MONOPENTAERYTHRITOL 4 PROPYLENE OXIDE DISTEARATE
$R_1 = CH_3-(CH_2)_{16}-COO-$ $R_2 = CH_3-(CH_2)_{16}-COO-$

MONOPENTAERYTHRITOL 4 PROPYLENE OXIDE MONOBEHENATE
$R_1 = CH_3-(CH_2)_{20}-COO-$ $R_2 = OH$

MONOPENTAERYTHRITOL 4 PROPYLENE OXIDE DIBEHENATE
$R_1 = CH_3-(CH_2)_{20}-COO-$ $R_2 = CH_3-(CH_2)_{20}-COO-$

Although in the formulas given herein some preferred pentaerythritol compounds that are useful in the practice of this invention are illustrated it will be understood that various other such pentaerythritol compounds within the description thereof herein may be employed too, including such as pentaerythritol dihydrogenated tallowate, pentaerythritol ditallowate, pentaerythrito dipalmitate, and dipentaerythritol tetratallowate. Also, in this specification when reference is to a compound of a class, unless it is indicated otherwise therein it is to be considered that the employment of mixtures of compounds of such class are intended to be included (commercial compounds are often mixtures).

The emulsions (which term herein is also intended to refer to dispersions and suspensions in liquid media, as well as to microemulsions [and sometimes solutions may be present, too]) of this invention will normally be aqueous emulsions in which the aqueous phase is the continuous phase, with the pentaerythritol compound being in the dispersed phase. However, solvents and cosolvents, such as ethanol, isopropanol, propylene glycol and various mono- and di-lower alkyl esters of diethylene glycol (Carbitols ®) may also be present to promote formations of stable products, when such is desirable.

Various emulsifiers can be employed, and many such are described in the various *Detergents and Emulsifiers* publications of John W. McCutcheon, issued annually, particularly those for 1969, 1973 and 1981. Preferred such emulsifiers are those which are higher alkyl ethers or amines which contain one or more hydroxyalkyl substituents too. Of these the more preferred are the higher alkyl dialkanolamines wherein the alkanol moieties are of 2 to 4 carbon atoms, preferably being 2 or 3 and more preferably being 2, and the higher alkyl lower di- or polyethylene glycol ethers of 4 to 10 carbon atoms, preferably the higher alkyl diethylene glycol ethers, in which emulsifying compounds the higher alkyl is of 8 to 24, preferably 12 to 18 carbon atoms. More preferred specific such emulsifiers are tallowalkyl diethanolamine, available from AKZO, Inc. as Ethomeen ® T12, and $R-O-(CH_2CH_2O)_2H$, wherein R is 67% $C_{13}$ and 33% $C_{15}$ alkyls, with such alkyls being straight chain, available from ICI Inc. as Synperonic ® A2.

When instead of emulsion form for the invented compositions it is desired that they be in particulate or powder form the carrier for the active pentaerythritol compound softening agent may be any suitable such particulate or powder material that is compatible with the mentioned softening agent, but it may often be preferred to employ such a material that can contribute some fabric softening action to the composition. Such a material is bentonite but other fabric softening clays and clay-like materials may be substituted for it, at least in part. Also, other non-functional substantially water insoluble carriers may be utilized, such as calcium carbonate and silica, and even water soluble carriers, such as sodium sulfate and other "filler salts" may be used. The bentonite employed should preferably be of a type which is gel forming in water and capable of softening fibrous materials, and should be of micron range ultimate particle size, although it may be agglomerated to larger sizes, usually in the range of 8 to 140 sieves, U.S. Sieve Series.

When it is desired to apply the pentaerythritol compound softening agent to laundry being dried in a laundry dryer, such as an automatic dryer, the pentaerythritol compound or mixture thereof may be applied to a substrate material, from which it may be transferred to the drying laundry under the influence of the heat in the drying air and the rubbing action of the substrate against the moving laundry. The substrate used may be paper or other fibrous material, sponge, preferably cellulose or polyurethane, or other suitable base material, with the pentaerythritol compound being such that it is solid at room temperature and liquefiable and/or softenable at dryer temperatures. The pentaerythritol compound may be blended with other suitable waxy type material, plasticizer or hardener to control the softening point thereof, when such is desirable.

Normally, in the various applications mentioned, the PEC will be employed without the presence of any other fabric softening material but it is possible to utilize such other materials with it if they are not ecologically unacceptable and if they do not interfere with the softening action of the PEC. In fact, sometimes, when antistatic action is desirable in the product, such additions may be important because although PEC's have some antistatic properties sometimes they are not sufficient for the intended purposes. Thus, it is possible to formulate fabric softening compositions and articles with the PEC supplemented by other fabric softeners and antistatic agents. The foremost of such materials are the quaternary ammonium salts but when they are present there can be ecological problems, due to their toxicities to aquatic organisms. For example, in standard toxicity tests against daphnia the concentration for 50% kill is less than 1 mg./l. for quaternary ammonium compounds or quats, such as ditallowalkyl dimethyl ammonium chloride, which is often unacceptable. Other fabric softeners and antistats include higher alkyl neoalkanamides, e.g., N-stearyl neodecanamide, isostearamides, amines, such as N,N-ditallowalkyl N-methyl amine, esterified quaternary salts or esterquats, amidoamines, amidoquats, imidazolines, imidazolinium salts, di-higher fatty acid esters of di-lower alkanolamines, such as dicoco acid ester of diethanolamine, silicones, alkoxylated silicones, and clays, e.g., bentonites and other montmorillonites, and representative examples of such are given below.

QUAT:

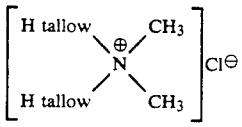

INIDAZOLINE

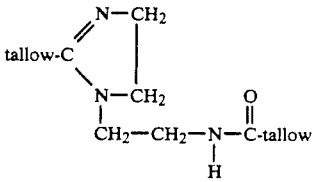

ESTERQUAT

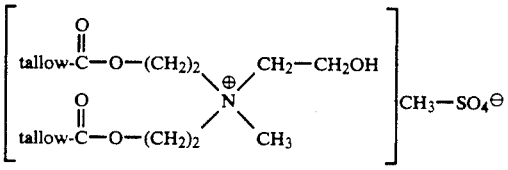

INIDAZOLINIUM SALT

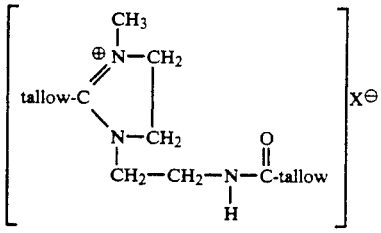

AMIDO AMINE

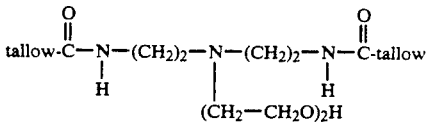

Silicon = polydimethylsiloxane

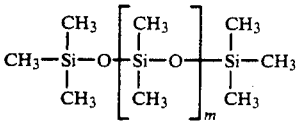

AMIDO QUAT

Clay

-continued

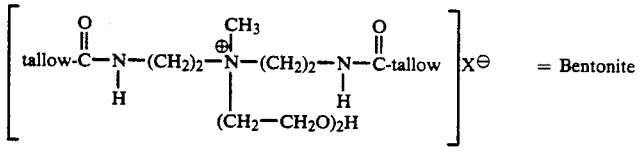

It should be kept in mind when employing supplementary fabric softeners and antistats that they should not make the compositions in which they are incorporated of greater ecotoxicity than is allowable by regulatory authorities in the area of intended use. Thus, quaternary ammonium compounds will usually be avoided, as will be compounds of similar adverse effects on aquatic organisms, or the amounts thereof present will be limited so as to avoid such undesirable effects.

Other materials that may be incorporated in the invented compositions include the usual adjuvants that normally are present in other fabric softening compositions, such as perfumes, fixatives solvents, cosolvents, hydrotropes, antioxidants, stabilizers, biodegradable antimicrobials, fillers, thickeners and fluorescent brighteners, all of which are known classes of materials in the fabric softening compositions field, with examples of several of these being given in the art mentioned in this specification, all of which is hereby incorporated herein by reference.

The last component of the present compositions, which is required in the aqueous emulsions, is water. Normally any clean water can be employed, such as any of a hardness in the range of to 500 p.p.m., as $CaCO_3$, but it will be preferred to use water of a hardness of no more than 150 p.p.m., more preferably less than 50 p.p.m., and most preferably the water will be deionized water that has been irradiated.

The proportions of components of the invented compositions and articles will be those which result in stable and effective products for fabric softening applications. For the PEC's the concentration in such compositions and articles will normally be in the range of about 1 to 25%, preferably 1 to 10%, more preferably 2 to 8% and most preferably 3 to 7%, e.g., about 5%, although for the articles percentages in the 10 to 20% range may often be preferred, depending on the type and density of the substrate material. For the emulsions the content(s) of emulsifier(s) will normally be in the range of 0.2 to 10%, preferably 0.5 to 5% and more preferably 1 to 3%, e.g., about 2%. When the emulsifier is made up of a higher alkyl lower alkanolamine and a higher alkyl dialkylene glycol monoether the proportion of the monoether will desirably be equal to or greater than that of the alkanolamine, preferably being from 1.1 to 2 times as much, e.g., about 1.5 times as much. Thus, such percentages can be from 0.1 to 3.3% of the amine compound and 0.1 to 6.7% of the monoether compound, preferably 0.2 to 1.7% and 0.3 to 3.3% and more preferably 0.3 to 1% and 0.5 to 2%. For example, as in compositions of the working examples, the percentages of such emulsifiers may be 0.8% of the amine type and 1.2% of the monoether type. The aqueous medium or water content of these compositions is the balance thereof, usually being in the range of 65 to 98.8%, preferably 85 to 98.5%. more preferably 87 to 97.5% and most preferably 90 to 96%, e.g., about 93%. It is to be understood that the presences of any adjuvants or supplemental components of the emulsions will be compensated for by corresponding decreases in the water contents of the compositions. tions Usually the total adjuvants content will be no more than 25%, preferably will be no more than 15% and in many instances will be held to a limit of 5%. None of the adjuvants employed will be such as to cause unacceptable levels of toxicity which could adversely affect aquatic organisms, including fish, that inhabit lakes and streams into which there are fed washing machine rinses that had been charged with the present compositions. Thus, the invented compositions may be considered to consist essentially of the named components, with only acceptable adjuvants being allowed to be present therein. As was previously mentioned the present compositions and articles are preferably essentially free of quaternary ammonium compounds Most preferably 0% of such are present but when the resulting compositions and articles are not ecotoxic increasing limits of 0 1%, 0.3% and 0.5% may be imposed, which are more preferred, preferred and acceptable limits respectively, under the circumstances, and can be within the invention.

One suitable adjuvant is an acidifying agent, such as hydrochloric acid, sufficient to cause the pH of the emulsion or other aqueous composition to be in the 2.5 to 5 5 range. To do that the percentage of HCl (concentrated basis) or equivalent other acidifying agent present will usually be in the range of 0.01 to 0.2%, preferably 0.05 to 0.1%.

When particulate or powder compositions or dryer articles are made the percentages of PEC's may be in the same ranges as given in the preceding paragraph or at least within the wider of such ranges but the powder carrier or the substrate (for the articles) may be the balance of the composition or product. If desired, emulsifier(s) may also be present in such compositions and articles, preferably in about the proportions previously given for the emulsions, and, of course, suitable adjuvants may be present, too. Thus, the fabric softening powders or particulate compositions may comprise 1 to 25% of PEC and 75 to 99% of carrier, such as bentonite, preferably comprise 1 to 10% of the PEC and 90 to 99% of the carrier, and more preferably comprise 3 to 7% of PEC and 93 to 97% of bentonite, e.g., 5% of tripentaerythritol tetralaurate and 95% of bentonite. The fabric softening article may comprise about 1 to 25% of PEC, with the balance being substrate material, or the percentage of PEC may be in the 5 to 20% or 10 to 20% range.

To manufacture the invented compositions and articles is comparatively simple but to produce applicants' desired stable emulsions (and microemulsions) a particular process is desirably followed. To produce the desired stable emulsions it is preferable that the PEC be melted before addition to the aqueous medium and the temperature to which the PEC is raised will desirably be within 10° C. of the melting point thereof. It is preferred that the PEC be mixed with any meltable emulsifier, especially one of lipophilic character (or more lipophilic character than another emulsifier present), such as the amine, when a mixed amine-monoether emulsifier is employed, and melted together with it, but alternatively the two meltable materials, PEC and amine, may be separately melted and added together or simultaneously to the aqueous medium (usually water), which should also be at about the same elevated temperature, about 60° C., for example. The water employed is often desirably acidified, as by addition to it of HCl or other suitable acid, until the pH thereof is in the range of 2 to 7, preferably 2.5 to 5.5, e.g., about 3.5. After the mixing the emulsion produced may be cooled to room temperature, with the balance of emulsifier (the monoether emulsifier, in many cases) being added before or after such cooling, preferably before. The result is a stable emulsion, which resists separation under normal elevated temperature conditions for periods of six months or more.

To manufacture the particulate or powdered product it is only required for the PEC.to be mixed with the carrier material. Preferably, the melted PEC, at elevated temperature, will be sprayed onto a tumbling mass of the particulate agglomerated bentonite or bentonite powder (or other carrier) and will thereby be distributed throughout it evenly. Sometimes the mixer employed will include size reduction means to make sure that the PEC is in small enough particles so as to promote even deposition on the laundry being treated. The bentonite or other carrier may be at room temperature when the PEC is being applied to it, and the PEC will be solidified on contact with the bentonite mass, usually with little agglomeration taking place, but by controlling the PEC proportion, the temperature and mixer speed, some agglomeration may be obtainable, when desired.

To make the softening article it is usually desirable for the substrate material, in a continuous strip, to be passed through a melt, emulsion or other bath of PEC, with any excess being removed by a doctor blade or squeeze rolls. After cooling or drying, the strip, containing the PEC, may be cut into individual pieces and is ready for use.

In use, the various invented composition and articles are employed in the same manners as other emulsions, powders and articles that apply fabric softener to laundry. The emulsion may be added to rinse water and so may the powder and particulate compositions, with the concentrations of PEC being in the range of about 0.001 to 0.005% of the rinse water. Alternatively, such compositions may be added to the wash water but in such cases the concentrations may be increased, often about 1 to 3 times. Dryer treatment articles may be used in the same manner as products currently being marketed for that purpose, with paper strips (or towels) or equivalent sponges being added to the dryer, usually with a sheet or strip of 300 to 800 sq. cm. being employed.

The following examples illustrate but do not limit the invention. Unless otherwise indicated all parts and percentages in this specification and the appended claims are be weight and all temperature are in °C.

EXAMPLE 1

| Component | Percent (by weight) |
|---|---|
| Pentaerythritol distearate | 5.00 |
| (1)Ethomeen T12 | 0.82 |
| (2)Synperonic A2 | 1.18 |
| Hydrochloric acid (concentrated) | 0.082 |
| Water, deionized | 92.918 |

-continued

| Component | Percent (by weight) |
|---|---|
| | 100.00 |

(1)N-tallowalkyl diethanolamide, which can be replaced by N-hydrogenated tallowalkyl diethanolamide (2)Higher alkyl monoether of diethylene glycol wherein the higher alkyl is approximately 67% of $C_{13}$ alkyl chain and 33% of $C_{15}$ alkyl chain A stable emulsion is made of the above formula by heating together the pentaerythritol distearate and the Ethomeen T12 to 60° C. and then admixing such melted mixture with the 60° C. acidified wat after which the Synperonic A2, also at 60° C., is admixed with the water emulsion of pentaerythritol distearate and Ethomeen T12. The resulting stable acidic emulsion, which is at a pH of about 3.5, is a good fabric softening composition, comparable in fabric softening action to a 5% aqueous emulsion or suspension of distearyl dimethyl ammonium chloride (DSDMAC) when tested against such quat, using hardened cotton terrycloth as the test fabric to be softened. DSDMAC has long been considered to be one of the most effective fabric softeners known in the art.

In the described tests the terrycloth employed is hardened by six treatments with an aqueous hardening composition that includes sodium silicate, sodium sulfate and sodium tripolyphosphate. Such hardening is effected to simulate hardening effects on laundry that are encountered in normal laundry operations and to accentuate differences between softening agents employed, and has been found to do so consistently.

When comparing two fabric softening compositions for softening action nine tests are run on each of such compositions, using 40 cm.×40 cm. hardened terrycloth swatches and washing each of them and rinsing them in rinse waters containing either of the fabric softening compositions. Evaluations of softening actions (or softnesses of the treated swatches) are made after 1, 5 and 10 washing/rinsing cycles, by six judges in blind comparison tests. Th washings effected are normal washing machine washings and the rinsin are in rinse waters containing 110 ml. of softening composition per 25 liters of water (0.44%, by weight), which are employed to treat 3 kg. of fabric or laundry, containing the test swatches. In some instances a mini-test may be carried out, using specially designed reduced scale washing and rinsing apparatuses, and it has been found that such test results are consistent with those from the full size tests. After rinsing, the swatches are air dried in a temperature and humidity-controlled room, while being maintained horizontal to prevent loss of the fabric softener from the fabric due to dripping. After drying the swatches are ready for softness evaluation by the jury.

The judges rate the swatches for softness by comparing them to a standard, which in the present case is a swatch that was treated with a softening composition that contained the same amount of DSDMAC as the amount of pentaerythritol distearate in the test composition. The judges' ratings are evaluated, using statistical techniques, and final results show whether the softening composition are equal in softening actions or whether one or the other is significantly better. By the described testing the experimental composition of this example is rated as about equal in fabric soften ing effect to the control composition that contained the quat (DSDMAC), whether one, five or ten cycles of washings and rinsings are used.

In similar separate testings, employing pentaerythritol dilaurate and pentaerythritol dibehenate, it was found that although such compositions were useful fabric softeners, they were not as effective as pentaerythritol distearate. Also, pentaerythritol monostearate and pentaerythritol tristearate compositions, while also possessing useful fabric softening properties, were not as effective in that respect as the pentaerythritol distearate.

In the above experiments instead of pure pentaerythritol distearate the pentaerythritol ester may be the di-tallowate or di-hydrogenated tallowate (in which the esterifying acid is tallow acid(s) or hydrogenated tallow acid(s), and the results obtained will be similar.

EXAMPLE 2

The procedure of Example 1 is followed, with the exception that in the formula thereof the pentaerythritol distearate is replac by tripentaerythritol tetralaurate, and it is found that the softeni action of such acidic compositions, which are at pH's in the range of 2.5 to 5.5, is comparable to that of the pentaerythritol distearate composition of Example 1. The tetralaurate is superior in softening action to analogues thereof wherein the ester is the tetrastearate and/or tetrapalmitate and/or tetraoleate, and it appears that such difference is attributable to the maintenance of a correct hydrophilic/lipophilic balance (HLB), inasmuch as the tripentaerythritol tetraester has fewer free hydroxyls per carbon atom than the pentaerythritol diester.

Instead of the pentaerythritol tetralaurate there may be substituted tripentaerythritol tetramyristate, tripentaerythritol tristearate, tripentaerythritol tritallowate, tripentaerythritol trihydrogenated tallowate, dipentaerythritol trilaurate, tetrapentaerythritol tetralaurate, pentapentaerythritol tetrastearate and pentapentaerythritol tetratallowate and various others of the pentaerythritol esters described herein, and fabric softening similar to that of the tripentaerythritol tetralaurate will be obtainable, without the need for the presence of quat fabric softener. In addition, for the described compositions the fabric softening component will also be satisfactorily rewettable (as opposed to being waxy in feel and water repellent, which are characteristics of the quats) and will aid perfume present in adhering to the fabric, so as to give it a desired and persistent fragrance.

EXAMPLE 3

| Component | Percent (by weight) |
|---|---|
| (3)Bentonite | 95.0 |
| Tripentaerythritol tetralaurate | 5.0 |
| | 100.0 |

(3)Gel-forming sodium bentonite

A powdered product is made by blending together the indicat pentaerythritol oligomer ester and the bentonite, and such may be agglomerated to particle size in the 10 to 100 sieve range, U.S. Sieve series, or the powder may be used as is or suspended in water, with or without the presence of emulsifying agent(s). The product is employed in the rinse water, with the concentration of the ester being the same as in Examples 1 and 2, and it is found that the composition described has fabric softening properties like those of DSDMAC compositions containing the same amount of quat as the ester content of such invented composition. Similar results are obtainable when the other named satisfactory esters are substituted for the tripentaerythritol tetralaurate. In all such cases the ester improves the fabric softening action of the bentonite significantly. Additionally, when in this example and in Examples 1 and 2 a silicone fabric softener, such as a dimethyl polysilicone or an aminosilicone, is also present, its softening action may be improved by the presence of the pentaerythritol ester.

In a variation of the formula of this example a dispersion of the tripentaerythritol tetralaurate in water may be made by mixing together 20 parts of clay, 2 parts of the pentaerythritol ester and 76 parts of water, with 2% of emulsifier being optional (preferred). The powder, agglomerate or emulsion may be added to the rinse water, as is preferable, or sometimes to the wash water, or the powder may be mixed with particulate detergent composition for use in the wash water, or the liquid may be mixed with liquid detergent composition for use in the washing step. One may also employ the preparations in both the rinsing and washing operations.

When other monomeric pentaerythritol esters of the types described in this specification are employed in the described compositions they usefully soften fabrics too, but it is considered that the pentaerythritol distearate, pentaerythritol dipalmitate and pentaerythritol dioleate represent the most effective, most readily available and most practicable (from a commercial viewpoint) of thes fabric softeners in the described compositions.

The fabric softening effects described can also be obtained when the emulsifiers employed are changed and when the proportions of fabric softening compound(s) and emulsifier(s) are changed, with the ranges mentioned in this specification. Thus, various other emulsifiers mentioned in the McCutcheon publications,-referred to previously, may be substituted for those of the present example and the favorable results reported will be obtained Similarly, aesthetic and functional adjuvants may be present, such as perfumes, brighten and others mentioned previously, and the desired softening results are obtainable.

What is surprising about these results is that the present compositions, which are devoid of quaternary ammonium compound fabric softener, the acknowledged most effective fabric softener presently known and in use, are fabric softeners of essentially equal softening effectivenesses (or nearly equal effectivenesses in some cases) and do not possess the undesirable properties of the quats (especially persistent toxicity vs. aquatic organisms, water repellency and reactivity with anionic compounds), so they can be used when and where quats are unacceptable. This is considered to be a significant discovery and represents a substantial advance in the art. However, when the disadvantages of the quats are not controlling, and when they may be tolerated or even desired as components of the fabric softening compositions, they and other previously mentioned cationic and other fabric softeners, antistatic agents and conditioners can be present in the described compositions in tolerable proportions, so that their effects can be obtained,in addition to those of the pentaerythritol esters

EXAMPLE 4

| Component | Percent (by weight) |
|---|---|
| Pentaerythritol distearate | 5.0 |
| Paper (toweling) | 95.0 |
| | 100.0 |

The pentaerythritol distearate is melted at 60° C. and the paper toweling is drawn through a bath of the melt under such conditions that the final withdrawn sheet includes 5% of the fabric softening pentaerythritol ester. The sheet resulting is then cut to desired size and the strips resulting, often about 10×25 cm., are internally and longitudinally cut or sliced to increase contact of the coated paper with tumbling laundry in a laundry dryer. When a sheet of this softening article is added to a laundry dryer that contains 3 to 4 kg of laundry to be dried (dry weight) it satisfactorily softens such laundry.

In modifications of the invention the article made may contain emulsifier(s), such as those described in the other working examples and elsewhere in this specification and may also contain other aesthetic and functional adjuvants. Also, other pentaerythritol esters, oligomeric pentaerythritol esters and lower alkoxylate pentaerythritol or oligomeric pentaerythritol esters mentioned in this specification may be substituted for the pentaerythritol distearate in the same proportion or the proportion may be changed, as in other examples and elsewhere in the specification, and similar results will be obtained. In some instances, as when the pentaeryth ritol ester or derivative thereof does not exert sufficient fabric softening, additional fabric softening, and sometimes additional antistatic action, may be obtained by incorporating in the melt or otherwise applying to the paper additional fabric softeners, such as bentonite, higher alkyl neoalkanamides,isostearamides, silicones and, when permissible, cationic fabric softeners, e.g., quats.

In other variations of the invention of this example the substrate paper may be replaced with other absorbent fibrous or cellular materials, such as cotton toweling, cloth, synthetic fabric and blends of cotton and synthetic fabric, e.g., cotton/polyester blends. In some instances cellulosic sponges may be used for the substrate and sometimes polyurethane and other synthetic sponges may be employed instead. Alternatively, the invented pentaerythrito ester compositions may be dispensed from dispensing articles and other applicators into the laundry dryer or into the rinse water in the washing machine to soften laundry therein.

The invention has been described with respect to various working examples and embodiments thereof but it is not to be considered to be limited to those because one of skill in the art, with the present specification before him or her, will be able to utilize substitutes and equivalents without departing from the invention.

What is claimed is:

1. A biodegradable fabric softening composition or article for application to laundry so that a fabric softening component thereof is deposited on the laundry and softens it, which fabric softening composition or article is non-toxic to aquatic organisms in waters into which waste waters containing such fabric softening component are discharged, which fabric softening composition or article comprises, by weight, 1% to 25% of the composition or article of a fabric softening component selected from the group consisting of a higher aliphatic C12–C22 ester of pentaerythritol, an oligomer of pentaerythritol, a C2–C3 alkylene oxide derivative of pentaerythritol or a C2–C3 alkylene oxide derivative of an oligomer of pentaerythritol, and mixtures thereof in or on a clay carrier for the softening compound and an adsorbent or cellular material, said carrier being 75% to 99% by weight of the composition or article and said composition or article being essentially free of quaternary ammonium compound fabric softener.

2. A biodegradable fabric softening composition in particulate or powder form for application to fibrous materials, so that the fabric softening component thereof is deposited on the fibrous materials and softens them, which fabric softening composition is non-toxic to aquatic organisms in waters into which waste waters containing such fabric softening component are discharged, which comprises, by weight, by weight, 1% to 25% of a fabric softening component selected from the group consisting of a higher aliphatic C12–C22 ester of pentaerythritol, an oligomer of pentaerythritol, a C2–C3 alkylene oxide derivative of an oligomer of pentaerythritol, and mixtures thereof, and 75%–99% of a clay carrier for said softening compound, said composition being essentially free of quaternary ammonium compound fabric softener.

3. A fabric softening composition according to claim 2 which comprises, by weight, 1% to 10% of said ester of pentaerythritol or said ester of an oligomer of pentaerythritol or a mixture thereof and 90% to 99% by weight of said carrier.

4. A fabric softening composition according to claim 3 wherein the particulate or powder carrier is a fabric softening clay and no quaternary ammonium compound is present.

5. A composition according to claim 2 wherein the fabric softening clay is bentonite and the fabric softening component is an oligomer of pentaerythritol which is incompletely esterified with a higher fatty acid of 12 to 22 carbon atoms.

6. A composition according to claim 5 which comprises 3 to 7& by weight of higher fatty $C_{12-18}$ partial ester of an oligomer of pentaerythritol and 93 to 97% by weight of bentonite.

7. A composition according to claim 6 which comprises about 5% by weight of tripentaerythritol tetralaurate and about 95% by weight of bentonite.

8. A fabric softening article according to claim 1 wherein said carrier is said an absorbent fibrous or cellular material which has deposited on it or absorbed thereby said the fabric softening component, on a fabric softening article basis.

9. A fabric softening article according to claim 8 wherein said carrier is a sheet of paper which has been impregnated with 5 to 20% of a partial higher fatty C12–C22 ester of pentaerythritol, a partial higher fatty C12–C22 ester of an oligomer of pentaerythritol or a mixture thereof.

10. A process for softening washed laundry which comprises applying to such laundry a fabric softening composition or article of claim 1 in such manner and under conditions that a fabric softening component thereof is deposited on the laundry and softens it.

11. A process according to claim 10 wherein the fabric softening composition is applied to the laundry and is in particular or powder form and comprises 1 to 25% by weight of fabric softening component and about 75 to 99% by weight of bentonite, which is dispersed in rinse water in a washing machine and at least partially deposits therefrom onto the washed laundry, thereby softening it.

12. A process according to claim 10 wherein the fabric softening article is applied to the laundry and is an absorbent fibrous or cellular material which has had deposited on it or absorbed by it 1 to 25% by weight of the fabric softening component, on a fabric softening article basis, said article being added to washed and rinsed laundry in an automatic laundry dryer, whereby the fabric softening component is transferred, at least in part, to the laundry being dried, and softens it.

* * * * *